US005423420A

United States Patent [19]

Bakx

[11] Patent Number: 5,423,420

[45] Date of Patent: Jun. 13, 1995

[54] COLLAPSIBLE BASKET STYLE ARTICLE CARRIER

[75] Inventor: Martinus C. M. Bakx, Goes, Netherlands

[73] Assignee: The Mead Corporation, Dayton, Ohio

[21] Appl. No.: 100,585

[22] Filed: Jul. 30, 1993

[30] Foreign Application Priority Data

Aug. 1, 1992 [GB] United Kingdom ..... 9216422

[51] Int. Cl.[6] ..... B65D 75/00

[52] U.S. Cl. ..... 206/139; 206/193; 206/427

[58] Field of Search ..... 206/139, 162, 193, 200, 206/427, 161

[56] References Cited

U.S. PATENT DOCUMENTS

| | | | |
|---|---|---|---|
| D. 162,988 | 4/1951 | Ringler | D9/346 |
| 2,359,678 | 10/1944 | Ringler | 206/189 |
| 2,431,932 | 12/1947 | Hall | 206/172 |
| 2,433,676 | 12/1947 | Ringler | 206/171 |
| 2,556,778 | 6/1951 | Ringler | 206/200 |
| 2,564,449 | 8/1951 | Ringler | 206/172 |
| 2,575,654 | 11/1951 | Casler | 206/183 |
| 2,794,572 | 6/1957 | Goss | 206/200 |
| 3,045,863 | 7/1962 | DeChelbor | 206/139 |
| 3,281,011 | 10/1966 | Bixler et al. | 206/200 |
| 3,814,238 | 6/1974 | Wood | 206/167 |
| 3,822,822 | 7/1974 | Arneson | 206/139 |
| 4,243,138 | 1/1981 | Wilson | 206/193 |
| 4,601,390 | 7/1986 | Rosenthal et al. | 206/427 |

FOREIGN PATENT DOCUMENTS

| | | | |
|---|---|---|---|
| 927800 | 6/1973 | Canada | 206/162 |
| 9209895 | 10/1992 | Germany . | |

*Primary Examiner*—Bryon P. Gehman
*Assistant Examiner*—Thomas P. Hilliard
*Attorney, Agent, or Firm*—Erwin Doerr

[57] ABSTRACT

A collapsible article carrier (c) of the basket type, includes opposed side walls (22, 48), opposed end walls (28,44; 30,46), a base (12), a medial partition structure (62,64; 120,122) connecting together the opposed end walls and disposed substantially centrally of the carrier and a plurality of transverse partition panels (84,86; 100,102) connecting the medial partition structure with each of the side walls and thereby creating a number of article receiving cells within the carrier. Corner panels (32, 34, 50, 52) are provided between each of the end walls and side walls of the carrier to form a bevelled corner arrangement and the relationship between the dimensions of the various panels defining each corner cell is such as to allow the carrier to collapse. The transverse partition panels are set at an inclined angle (other than 90°) between the medial partition structure and the associated side wall.

6 Claims, 5 Drawing Sheets

COLLAPSIBLE BASKET STYLE ARTICLE CARRIER

BACKGROUND OF THE INVENTION

This invention relates to a collapsible cellular article carrier of the basket type preferably for accommodating a number of bottles. The carrier usually is formed from a single blank of e.g. paperboard and comprises a series of cells provided on opposite sides of a longitudal medial partition which incorporates a handle structure by which the carrier can be grasped and carried. Each cell in each series is separated from an adjacent cell in the same cell series by means of a hingable transverse partition structure which extends from the medial partition and is secured to an adjacent side wall of the carrier by means of an anchoring tab carried by the transverse partition struction. This form of collapsible article carrier for bottles is well known. In some applications however, article carriers of this general description are adapted for use with plastics bottle crates. In this connection the crates are utilized to accommodate several such article carriers filled with bottles or, alternatively, a multiplicity of single ie. unpackaged bottles.

It is known specifically to adapt article carriers to be received in plastics bottle crates and for this purpose the bottom wall panels of such article carriers include apertures by which the carriers can be received on retaining posts upstanding from the bottom of a crate.

It has been found that difficulties would arise with the collapsibility of this type of article carrier when adapted for fitment into certain forms of these crates. The compatibility between the basket type article carrier and the crate can be enhanced if the article carrier is better adapted to conform to the configuration of the internal structure of the crate. An article carrier according to the present invention is formed so that each of its corners (where a side wall meets an end wall) is formed, by the provision of an additional corner panel, to provide a "bevelled" corner arrangement. Not only does this arrangement improve, in certain important instances, the compatibility between the basket type article carrier and the crate but also provides an improved appearance to the carton.

However, such a bevelled corner structure can make collapse of the carton into a flat form for shipment unattainable. Bevelled corner panels in these types of bottle carrier are known per se, for example, from U.S. Pat. No. 2,433,676.

SUMMARY OF THE INVENTION

One aspect of the present invention provides a collapsible carrier of the basket type comprising substantially parallel side and end walls and a medial partition structure extending between said end walls substantially centrally of said carrier, corner panels interposed between each of said side and end walls to form a bevelled corner at each corner of said carrier, at least one transverse partition panel connecting said medial partition structure with an adjacent one of said side walls, said transverse partition panel being hinged to said medial partition structure along a first hinge line and to said one adjacent side wall along a second hinge line, characterized in that said transverse partition panel extends between said medial partition structure and said one adjacent side wall at an angle other than 90° so as to facilitate collapse of said carrier, about said medial partition structure.

Another aspect of the present invention provides a collapsible carrier of the basket type comprising substantially parallel side and end-walls and a medial partition structure extending between said end walls substantially centrally of said carrier, corner panels interposed between each of said side and end walls to form a bevelled corner at each corner of said carrier, at least one transverse partition panel connecting said medial partition structure with an adjacent one of said side walls, said transverse partition panel being hinged to said medial partition structure along a first hinge line and to said one adjacent side wall along a second hinge line, characterized in that the breadth of said transverse partition panel is greater than the distance between said medial partition structure and said one adjacent side wall.

According to a feature of either aspect of the invention said end wall may comprise two end wall panels hinged at one end thereof to said side walls and at the other end thereof to said medial partition structure at opposite ends thereof. In constructions where two end wall panels are provided said medial partition structure may be formed by two medial panels joined to said end wall panels at one end of the carrier.

According to a further feature of either aspect of the invention the sum of the dimensions (as measured in a horizontal plane) of said end wall panel, corner panel plus that portion of the associated side wall which extends from the juncture with said corner panel to said second hinge line may be substantially equal to the sum of the dimension (as measured in a horizontal plane) along the medial partition structure from the juncture with said end wall panel to said first hinge line plus the breadth of said transverse partition panel.

According to a still further feature of either aspect of the invention, said transverse partition panel may be disposed at an angle of less than 90° with respect to said medial partition structure and, as viewed form the top, may be inclined toward the adjacent one of said end walls. Preferably, the carrier is arranged to collapse in the direction in which said transverse partition panel is inclined.

According to yet another feature of either aspect of the invention, the carrier may comprise two transverse partition panels on each side of the medial partition structure and in that said two transverse partition panels are, as viewed from the top, parallel with respect to each other. Preferably, the transverse partition panels are joined to a common anchoring tab along said second hinge lines.

According to a still further feature of either aspect of the invention, the carrier may further comprise a bottom wall joined to opposing side walls at the lower ends thereof and include a bottom sloping panel extending from the lower ends of said side walls.

An embodiment of the invention will now be described, by way of example, with reference to the accompanying drawings in which

DESCRIPTION OF THE PREFERRED EMBODIMENT

Figure 1:
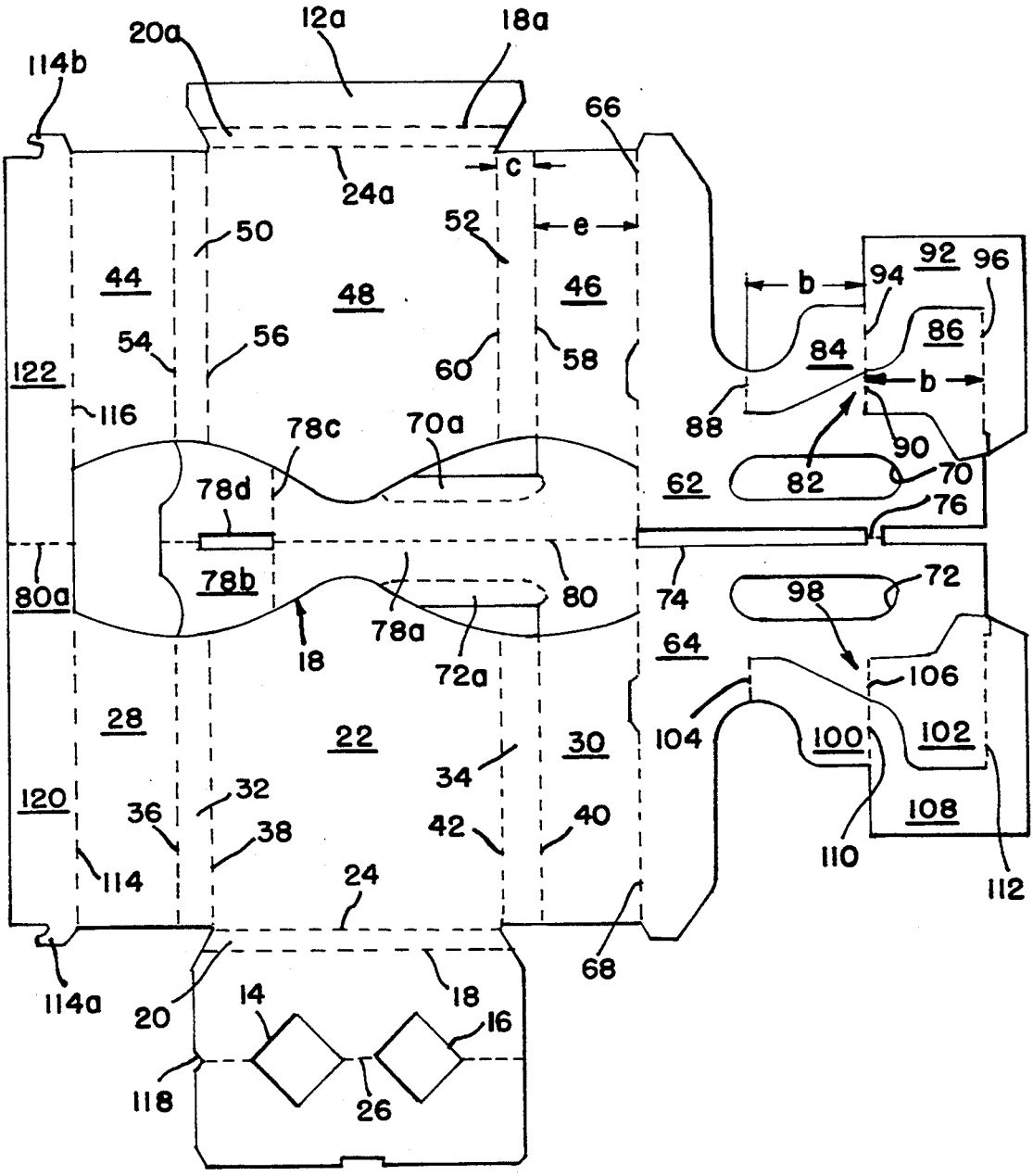
FIG. 1 is a plan view of a paperboard blank from which an article carrier according to the present invention is formed.
Figure 5:
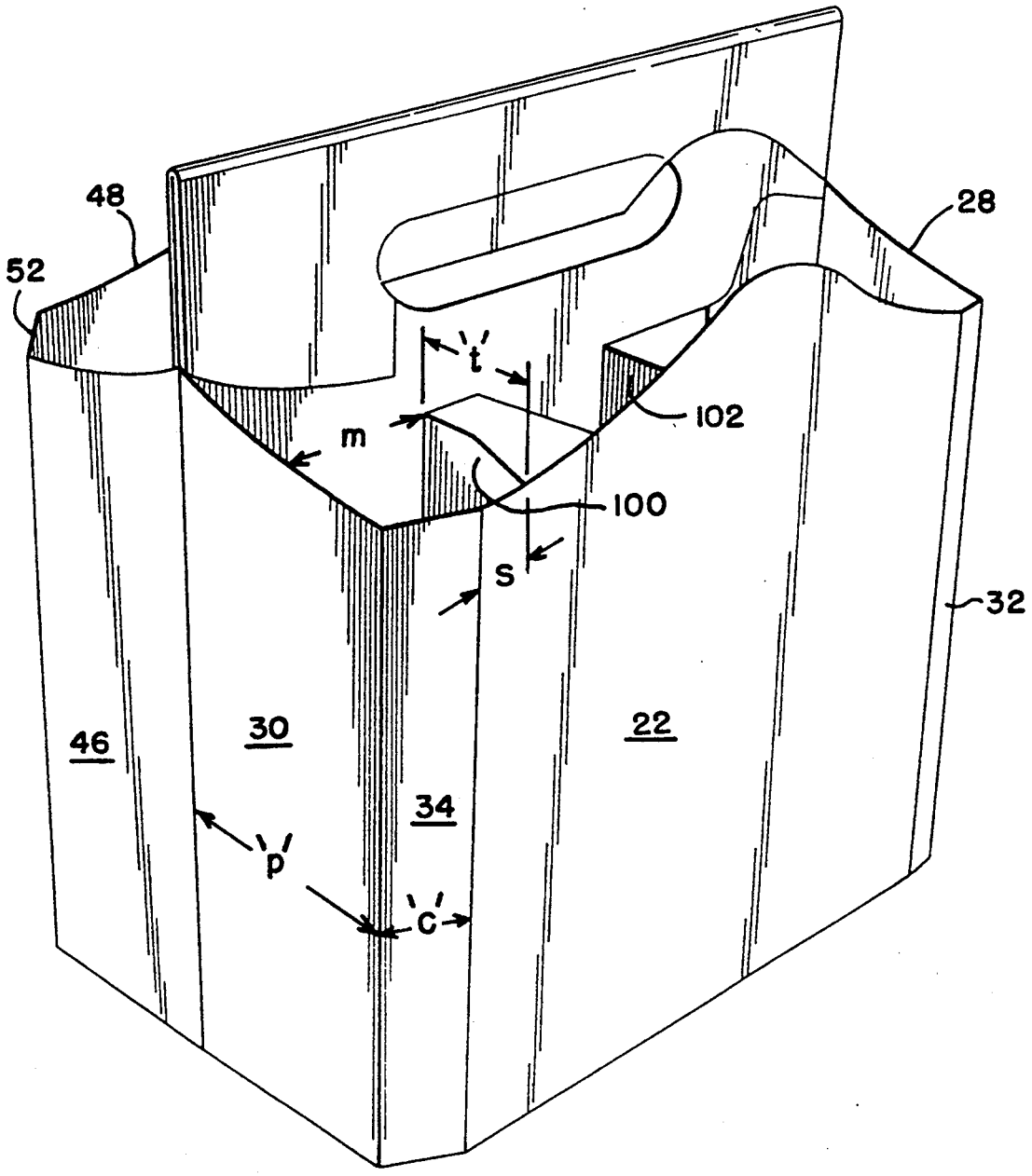
FIG. 5 is a perspective view from above and from one corner of the carrier in its set-up condition.

Referring to the drawings, there is shown in FIG. 1 a unitary blank 10 formed from paperboard or similar foldable sheet material for producing a carrier C (FIG. 5). The carrier C comprises a bottom wall 12 which includes a pair of openings 14, 16 respectively by which the carrier, when in its set-up condition, can be impaled upon a pair of posts upstanding from the bottom of a bottle crate (not shown). A side edge of the bottom wall is foldably joined along a fold line 18 to a bottom sloping panel 20 which in turn is foldably joined to one of the side walls 22 of the carrier along the fold line. The bottom wall 12 is formed with an interrupted central fold line 26. In order to complete the bottom of the carrier, a bottom glue flap 12*a* is hinged to a further bottom sloping panel 20*a* along fold line 18*a*, panel 20*a* in turn being hinged to side wall 48 along fold line 24*a*. The free edge of panel 12 remote from panel 20 is secured to bottom flap 12*a* in order to form the bottom of the carrier. The carrier further comprises end wall panels 28 and 30 each of which is foldably joined to the side wall 22 by means of corner "bevelled" panels 32 and 34 respectively. End wall panel 28 is foldably joined to corner panel 32 along fold line 36 and corner panel 32 is foldably joined to side wall 22 along fold line 38. Likewise end wall panel 30 is foldably joined to corner panel 34 along fold line 40 and corner panel 34 is foldably joined to side wall 22 along fold line 42.

Similarly, at the opposite end of the carrier, end wall panels 44 and 46 are joined to side wall panel 48 by means of "bevelled" corner panels 50 and 52 respectively. Thus, end wall panel 44 is foldably joined to corner panel 50 along fold line 54 and corner panel 50 is foldably joined to the side wall panel 48 along fold line 56. End wall panel 46 is foldably joined to corner panel 52 along fold line 58 and corner panel 52 is foldably joined to side wall panel 48 along fold line 60.

A medial partition structure for the carrier is provided, in part, by medial panels 62 and 64 which are foldably joined to end wall panels 46 and 30 along interrupted fold lines 66 and 68 respectively. Medial panel 62 includes a handle panel portion from which is struck a handle opening 70. A like provision for a handle arrangement is made in medial panel 64 which includes a handle panel opening 72 being substantially a mirror image of the opening 70 on the opposite side of an interrupted linear gap 74 provided between the medial panels 62 and 64 which facilitates folding between panels 62 and 64. This gap is bridged in the vicinity of the handle openings by a bridging strip 76.

A handle reinforcing panel 78 is struck from the blank on the left hand side of the fold lines 66, 68 (as seen when viewing the blank in FIG. 1) and comprises a main reinforcing panel 78*a* and a locking panel 78*b*. These panels 78*a* and 78*b* are symmetrical about a central fold line 80 which is coincidental with the linear gap 74 between handle openings 70 and 72. The handle reinforcing panel 78 includes a pair of aligned hand cushioning flaps 70, 72*a* which are hinged in cutaway portions of the handle reinforcing flap and positioned so that when the medial panels 62 and 64 are folded through 180 degrees to the left hand side about fold lines 66, 68 the hand cushioning flaps 70*a* and 72*a* are disposed in register to cover a portion of the handle openings 70 and 72 respectively.

The locking flap 78*b* is hinged to the main part of the handle reinforcing panel 78*a* by means of a fold line 78*c* and a cut out portion 78*d* to facilitate folding is provided along the extension of fold line 80 which extends into the locking tab 78*b*.

Medial panel 62 is formed with a hinged extension to form a transverse partition structure generally designated reference numeral 82. Transverse partition structure 82 comprises adjoined transverse partition panels 84 and 86 each of which are hinged to the medial panel 62 along short hinge lines 88 and 90 respectively. These short hinge lines lie parallel to the fold line 66. On the opposite end of the transverse partition panel a common anchoring tab 92 is provided which completes a portion of the right hand side of the blank and is hinged to each of the transverse partition panels 84 and 86 along short hinge lines 94 and 96 disposed parallel to hinge lines 88 and 90 respectively. The common anchoring tab 92 is secured against the side wall 48 of the carrier when the blank is formed.

Figure 2:
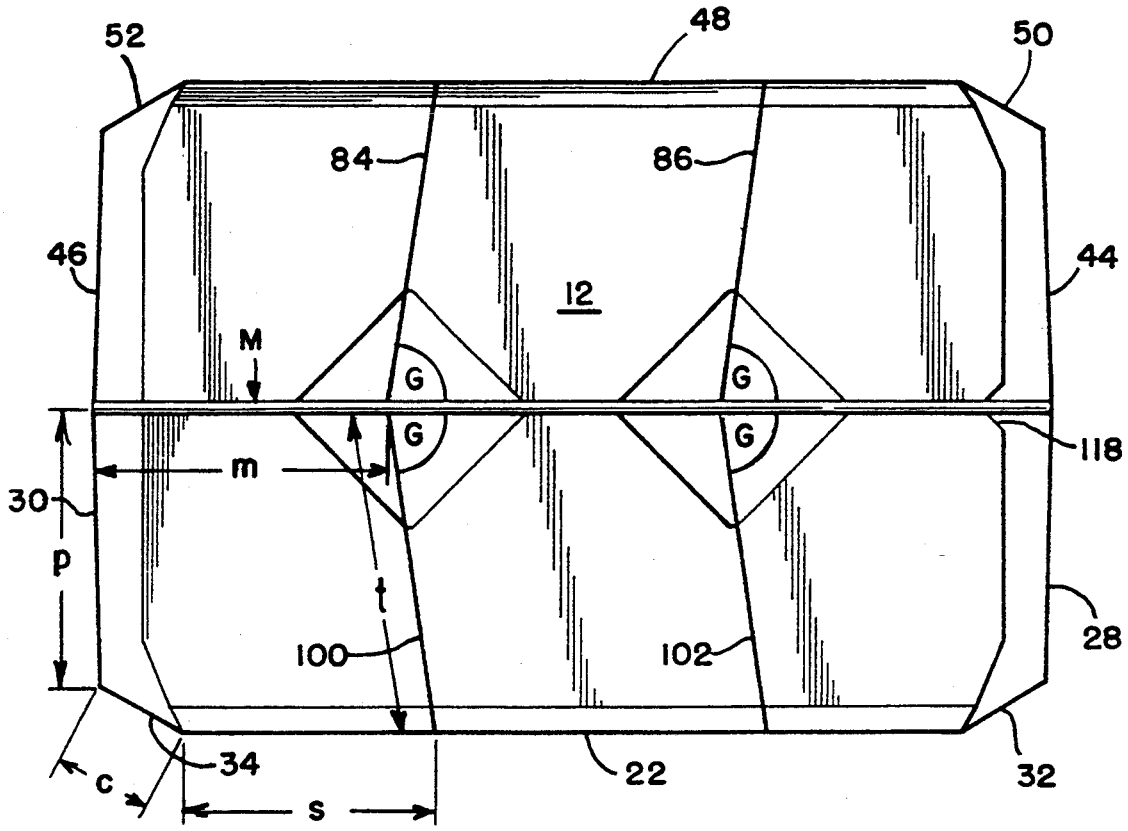
FIG. 2 is a plan view from above of the carrier in its set-up condition.
Figure 3:
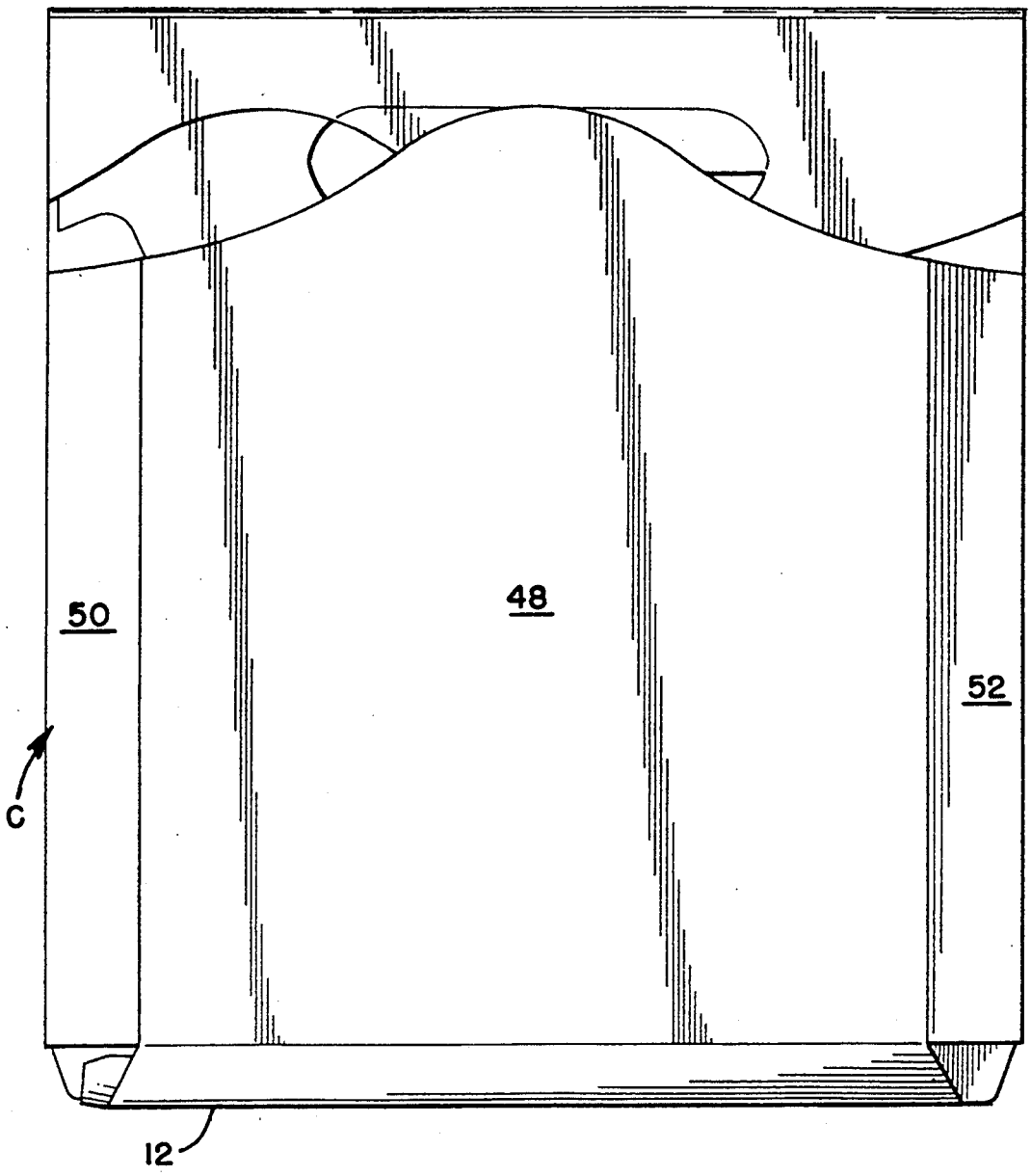
FIG. 3 is a side elevation of the carrier shown in its set-up condition.
Figure 4:
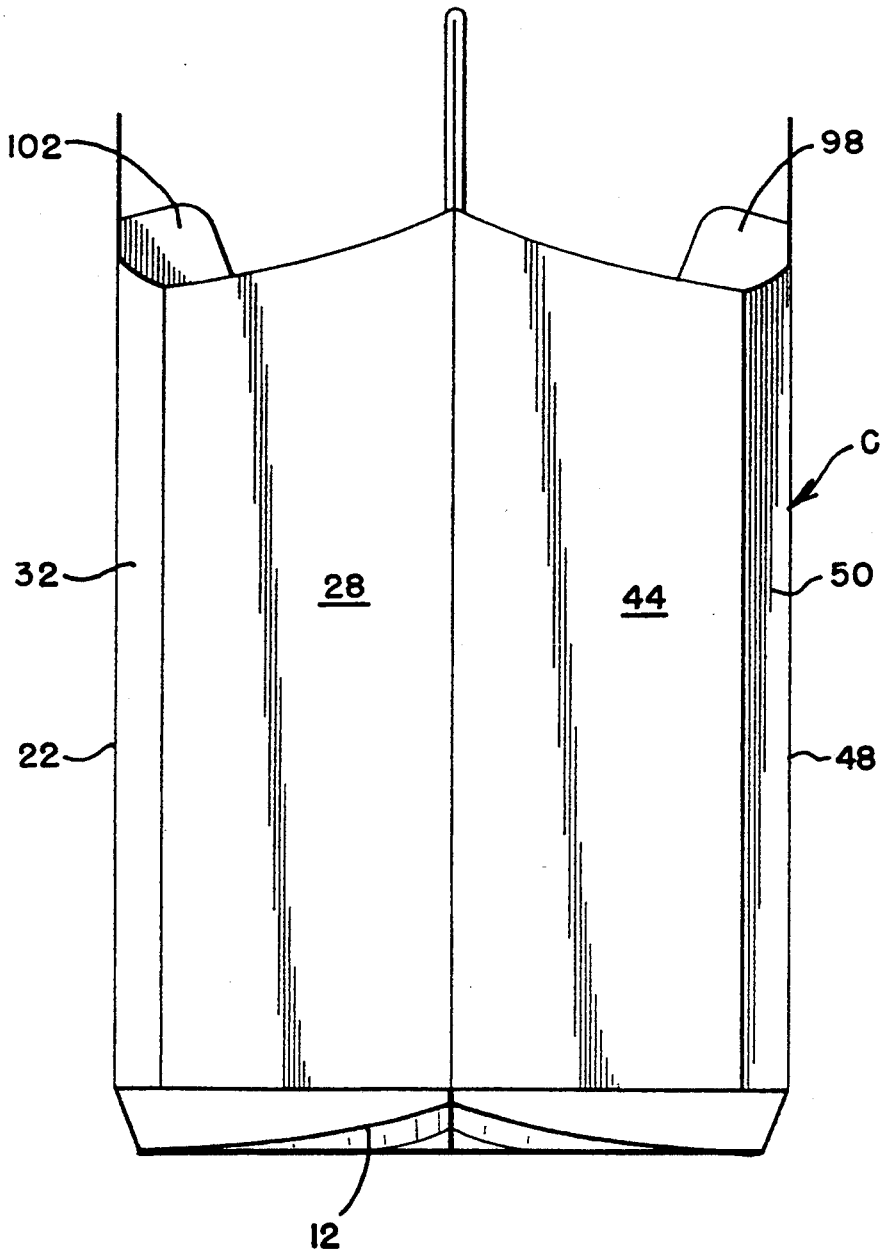
FIG. 4 is an end elevation of the carrier shown in its set-up condition.

When the carton is formed, the hinge lines 88, 90 and 94, 96 allow the transverse partition panels 84, 86 to pivot from a collapsed position in which they lie virtually flat against the medial partition structure to a set up position in which they extend between the medial partition structure and the adjacent side wall 48 at an acute angle G°, (FIG. 2). Likewise a hinged extension 98 of the medial partition panel 64 provides transverse partition panels 100 and 102 which are hinged to medial panel 64 along short hinge lines 104, 106 respectively. Hinge lines 104, 106 lie parallel to the fold line 68. On the opposite end of the transverse partition panels a common anchoring tab 108 is provided which completes a further portion of the right hand side of the blank. Anchoring tab 108 is hinged at spaced locations 110, 112 to the transverse partition panels 100 and 102 respectively. Similarly to panels 84 and 86 an angle of G° is subtended between the inclined transverse partition panels 100, 102.

In order to render the carrier collapsible the dimensions of certain of the panels in relation to others are of importance. In this case the sum of the dimensions, 'p' 'c' and 's' (as measured in a horizontal plane) of one end wall panel, (30) the adjoined corner panel (34) and that portion of the associated side wall (22) which extends from the juncture with the corner panel 30 to the second hinge line is substantially equal to the sum of the dimensions 'm' as measured in a horizontal plane along the medial partition structure from the juncture with end wall panel (30) to the first hinge line plus the breadth 't' of the transverse partition panel (100).

The relationship between like related panels at other positions in the carrier is similar. Thus, at each corner cell of the carrier $p+c+s=m+t$ and hence 't' is greater than the distance between 'M' and side wall 22. This arrangement allows the carrier to collapse about the medial partition structure in the direction of inclination of the transverse partition panels, ie. to the right as viewed in FIG. 2

Further medial panels 120, 122 are hinged to end walls 28 and 44 about fold lines 114 and 116 respectively and are hinged to one another about a central fold line 80*a*. Fold line 80*a* is coincident with fold line 80 and the gap 74 between the medial petition panel 62 and 64. Medial panels 120 and 122 each have a hook formation 114*a* and 114*b* respectively which, when the carrier is formed are brought together into face to face relationship to provide a locking hook for engagement into a V-shaped notch 118 formed in the base panel of the carton. This engagement between the locking hook and the base panel is well known in the art and enables the carton to remain in a set-up condition while loading takes place.

As mentioned above, it is usual for bottle carriers of this type to be supplied to a user, ie. a bottling plant in a flat collapsed condition whereafter the carrier is erected filled and thereafter loaded into a crate. Thus, the blank is pre-glued by the carton convertor and put into the form of the completed carrier in flat collapsed condition. To do this first an application of glue is made to both the anchoring tabs 92, 108 and to areas of the medial panels 62 and 64 adjacent the gap 74, and to the locking flap 78*b*. Thereafter all those portions of the blank to the right hand side of the fold lines 66, 68 are folded through 180° towards the lefthand side of the blank as viewed in FIG. 1 about fold lines 66, 68. This folding step secures the anchoring tabs 92 and 108 to the side walls 48 and 22 respectively. Those portions of the blank on either side of the linear gap 74 are adhered to portions of the blank on either side of fold line 80 when the anchoring tabs are secured to the side walls.

The locking tab 78*b* which is then folded 180° to the righthand side about fold line 78*c* and secured to the upwardly facing portions of the handling panels 82 and 98.

Thereafter exposed faces of the medial panel 62 and 64 have an application of glue made to them as does the exposed face of the locking panel 78*b* together with areas of the blank immediately adjacent to fold line 80*a* between medial panels 120, 122. A further fold is made to the blank about fold lines 36, 54 to bring end walls 28 and 44 and medial panels 120, 122 through 180° to the right so that the portions of the blank immediately adjacent to fold line 80*a* are secured to the exposed face of the locking panel 78*b*.

Thereafter the exposed faces of medial panels 120, 122 have an application of glue made to them as do the exposed faces of medial panels 62 and 64 together with areas of the blank immediately adjacent to linear gap 74. Base panel 12 is folded in two by bringing the lower part portion of the panel into face to face relationship with the upper portion about interrupted fold line 26 and thereafter an application of glue is made to the glue flap 12*a*.

Thereafter the whole of the lower portion of the part folded blank below the linear gap 74 and fold line 80 is folded upwardly to 180° so that medial panel 120 and medial panel 64 is brought into face to face contact with medial panels 122 and 62 respectively. This folding operation also brings the free edge of the bottom panel 12 into face to face relationship with the bottom glue flap 12*a*. This completes the folding and gluing operations to convert the flat blank into the completed carton in its flat collapsed condition.

What I claim is:

1. A collapsible carrier of the basket type comprising substantially parallel side and end walls and a medial partition structure extending between said end walls substantially centrally of said carrier, corner panels interposed between each of said side and end walls to form a bevelled corner at each corner of said carrier, transverse partition panels connecting said medial partition structure with an adjacent one of said side walls and being hinged to said medial partition structure along a first hinge line and to said one adjacent side wall along a second hinge line, the breadth of said transverse partition being greater than the distance between said medial partition structure and said one adjacent side wall, characterized in that at least two transverse partition panels are provided on each side of the medial partition structure so that said at least two transverse partition panels are, as viewed from the top, parallel with respect to each other.

2. A carrier according to claim 1 wherein said transverse partition panels are disposed at an angle of less than 90° with respect to said medial partition structure and, as viewed from the top, are inclined toward the adjacent one of said end walls.

3. A carrier according to claim 2, further characterized in that it is arranged to collapse in the direction in which said transverse partition panels are inclined.

4. A carrier according to claim 1, further characterized in that said transverse partition panels are joined to a common anchoring tab along said second hinge lines.

5. A carrier according to claim 1 further comprising a bottom wall joined to opposing side walls at the lower ends thereof and including a bottom sloping panel extending from the lower ends of said side walls.

6. A collapsible carrier of the basket type comprising substantially parallel side and end walls and a medial partition structure extending between said end walls substantially centrally of said carrier, corner panels interposed between each of said side and end walls to form a bevelled corner at each corner of said carrier, each of said end walls comprising two end wall panels hinged at one end to said medial partition structure and at the other end to the respective corner panel, at least one transverse partition panel connecting said medial partition structure with an adjacent one of said side walls, said transverse partition panel being hinged to said medial partition structure along a first hinge line and to said one adjacent side wall along a second hinge line, the breadth of said transverse partition panel being greater than the distance between said medial partition structure and said one adjacent side wall, characterized in that the sum of the dimensions of one of said end wall panels, corner panels plus that portion of the associated side wall which extends from the juncture with said corner panel to said second hinge line, as measured in a horizontal plane, is substantially equal to the sum of the dimensions measured in a horizontal plane along the medial partition structure from the juncture with said one of said end wall panels to said first hinge line plus the breadth of said transverse partition panel.

* * * * *